United States Patent [19]

Yashima

[11] Patent Number: 4,648,823

[45] Date of Patent: Mar. 10, 1987

[54] PRESS EQUIPMENT WITH SUPPORTING AND LEVELLING APPARATUS FOR PRODUCING MOLDING COMPOUND PARTS BY COMPRESSION

[75] Inventor: Tsuneaki Yashima, Takasago, Japan

[73] Assignee: Kawasaki Yucoh Co., Ltd., Hyogo, Japan

[21] Appl. No.: 709,064

[22] Filed: Mar. 6, 1985

[30] Foreign Application Priority Data

Apr. 18, 1984 [JP] Japan ..... 59-79125

[51] Int. Cl.[4] ..... B30B 15/24

[52] U.S. Cl. ..... 425/150; 100/46; 425/406

[58] Field of Search ..... 425/138, 149, 150, 152, 425/406, 408, 411, 214, 167, DIG. 201; 100/46; 264/320

[56] References Cited

U.S. PATENT DOCUMENTS

| | | | |
|---|---|---|---|
| 2,377,007 | 5/1945 | Hess | 100/46 |
| 2,759,330 | 8/1956 | Van Broekhoven et al. | 100/46 |
| 2,915,961 | 12/1959 | Parkinson | 100/46 |
| 3,635,074 | 1/1972 | Moos et al. | 100/258 A |
| 4,457,072 | 7/1984 | Andersen | 33/143 L |
| 4,547,847 | 10/1985 | Olig et al. | 364/148 |
| 4,557,889 | 12/1985 | Masuda et al. | 264/320 |

*Primary Examiner*—Jay H. Woo
*Assistant Examiner*—J. Fortenberry
*Attorney, Agent, or Firm*—Birch, Stewart, Kolasch & Birch

[57] ABSTRACT

Molding compound parts with uniform wall thickness are precisely and repeatedly produced by compression, though supporting rods and levelling devices used for supporting the platen of press equipment which tilt during compression. The press equipment of the present invention is provided with levelling devices for supporting the platen at the four corners on the bed. The supporting rods of the levelling devices are hollow, with position detecting means vertically mounted therein so that the height of the supporting rods can be precisely detected and the rods can be synchronously controlled so as to make the upper mold half parallel to the lower mold half of the mold without magnifying the error caused by the inclination of the supporting rods.

9 Claims, 3 Drawing Figures

PRESS EQUIPMENT WITH SUPPORTING AND LEVELLING APPARATUS FOR PRODUCING MOLDING COMPOUND PARTS BY COMPRESSION

BACKGROUND OF THE INVENTION

The present invention relates to press equipment with supporting apparatus for producing molding compound parts by compression.

Molding compound parts by compression have been made of molding compound materials which are fluidized to flow and fill a mold cavity. But, it is necessary to precisely move a moving platen of a press so as to maintain an upper mold half parallel to a lower mold half for producing parts with precise, even wall thickness. According to a permitted limit, the allowable gradient of the platen is from 0.1 mm to 0.15 mm per 3 meters of length or width. Therefore, conventional presses are needed with greatly increased stiffness in their frames, and high precision in order to move the platen as above described. However, it is not only uneconomical, but also difficult in practical application. Furthermore, in coating molded parts, the thickness of the coating film is usually required to be within about 0.1 mm to 0.15 mm, and it is desirable to coat the coating materials more thinner and more evenly on the molded parts.

The applicant has developed several methods and apparatus for producing molding compound parts by compression, for instance as shown in U.S. application Ser. No. 416,488 and Ser. No. 416,556, where the press equipment are provided with levelling devices at the four corners on the bed for supporting the platen so as to move parallel within the necessary stroke range. But, as shown in FIG. 1, the above levelling device 2 was composed of a position detector 4 such a linear scale, and the detector 4 was mounted on the upper portion of the supporting rod 6 like a cantilever.

Therefore, when the supporting rods 6 are inclined according to the clearance or abrasion of the sliding surface members 8, the positioning detectors 4 are inclined as shown in dotted lines, and the detecting error is greatly increased. In the above conventional methods and apparatus the levelling precision could not be raised, even if the precision of the position detectors could be raised. Thus, the conventional levelling precision has a limit.

SUMMARY OF THE INVENTION

Therefore, an object of the present invention is to provide novel and useful press equipment with supporting apparatus for producing molding compound parts by compression.

Another object of the present invention is to provide press equipment with supporting apparatus for producing precise molding compound parts, which can control its moving platen with precise high positioning without magnifying the positioning error by the inclination of the supporting rods of the levelling device for supporting the platen, and can fluidize molding compound materials evenly to flow and fill a determined mold cavity so that molding compound parts with even wall thickness can be produced.

Another object of the present invention is to provide press equipment which can be compactly constructed without greatly increasing the stiffness of their frames, even if the platen can be precisely controlled and synchronously detect the height of the supporting rods.

Other objects and advantages of the present invention will become apparent from the following description.

DETAILED DESCRIPTION

Figure 1:
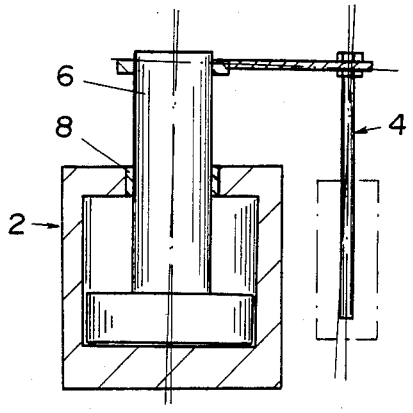
F I G. 1 PRIOR ART
FIG. 1 is a fragmentary sectional side view of a conventional supporting apparatus for press equipment.
Figure 2:
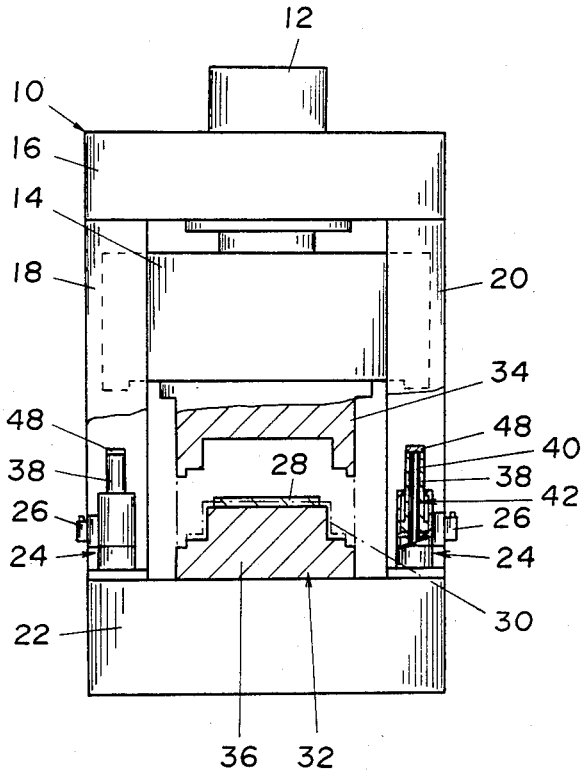
FIG. 2 is a schematic fragmentary sectional side view of an embodiment of an apparatus for carrying out the present invention.
Figure 3:
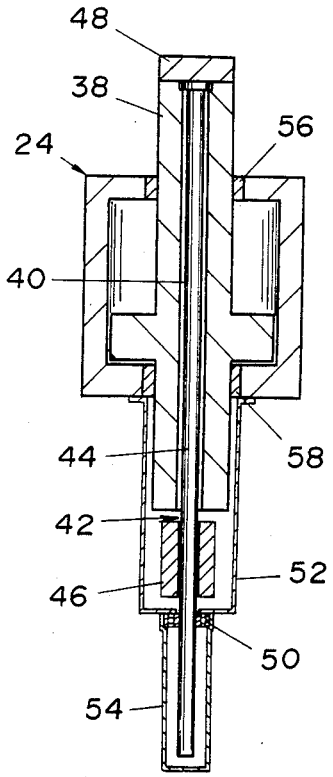
FIG. 3 is an enlarged fragmentary sectional side view of the supporting apparatus of the present invention of FIG. 2.

Referring to FIG. 2, there is seen an exemplary illustration of a preferred embodiment of the press equipment of the present invention. The press equipment 10 is an embodiment of a hydraulic press apparatus having a determined, necessary, large pressing power and long pressing stroke. The required large power and long stroke of the hydraulic compression cylinder 12 for moving the platen 14 is supported by the upper frame 16, and the platen 14 is arranged between the lateral frames 18 and 20 so as to slidably move in the vertical direction toward the lower bed 22. At the four corners of the longer side on the bed 22, levelling devices 24 such as hydraulic cylinders with double rods are respectively and vertically provided so as to support in parallel the moving platen 14 and they are designed to be smoothly actuated in the vertical direction by respective hydraulic servo valves 26, the levelling devices 24 are constructed to have small power such as from one-half to one-fifth of that of the compression cylinder 12, and their strokes are as short as necessary for fluidizing a sheet molding compound material 28 to a determined mold cavity 30 of the mold 32 and compressing it to a desired form in the mold 32. The mold 32 consists of an upper mold half 34 secured on the platen 14 and a lower mold half 36 secured on the bed 22, if necessary secured on a bolster (not shown), as shown in FIG. 2. The supporting rods 38 of the levelling devices 24 are respectively hollow as shown in the figure. In each hollow aperture 40, position detecting mean 42 such as a linear scale, is vertically provided, as shown in FIG. 3. Each detecting mean 42 consists of a vertical straight position detecting rod 44 such an Inductosyn scale and a position detector 46 such an Inductosyn detector. The detecting rod 44 has fixed at its upper end a lid 48 of the supporting rod 38, and its lower portion extends from the lower end of the supporting rod 38 and is slidably secured within a bearing member 50 mounted in a fixed member 52. The movement of the supporting rod 38 is detected by the position detecting means 42, and each rod 38 is synchronously controlled so that the platen containing the upper mold half can be lowered in parallel with the lower mold half. As above described, the levelling devices 24 are designed so as to be able to synchronously and precisely control the position and speed of their supporting rods 38 according to a determined programmed control. Numeral 54 represents a cover for the position detecting rod 44.

Thus, a softened sheet of molding material 28 is put on the lower mold half 36 of the mold 32 which has been opened by raising the platen 14. The compressing cylinder 12 is actuated by a hydraulic unit (not shown) and the platen 14 is softly lowered on the supporting rods 38 of the levelling device 24. Then, the platen 14 is lowered in parallel by being supported on the levelling devices 24. The movement of the rods 38 are detected by the detectors 46 and the speed and position levelling devices 24 are respectively and synchronously controlled so as to maintain the upper mold half 34 parallel to the lower mold half 36. As the position detecting rods are respectively equipped in the hollow apertures of the supporting rods, even if the supporting rods of the levelling devices are inclined due to warping and tilting of the frames or the platen, and even if the supporting rods are inclined by the clearance or abrasion of the sliding surface members of the levelling devices, the position detecting rods are not inclined with the magnified error of conventional cantilever detectors. Therefore, the inclined error can be reduced to as little as possible. So, the platen can be precisely supported in parallel by the levelling devices and the molding material can be precisely molded with an even wall thickness.

Furthermore, in this embodiment, the supporting rods 38 are constructed of hydraulic cylinders with double rods, and the supporting rods 38 are vertically supported at both of the sliding surface supporting members 56 and 58 of the upper and lower portions of the hydraulic cylinders. With this structure the inclination of the supporting rods can be as little as possible, and the sliding supporting members can lengthen their precise surface supporting life so that the levelling devices can precisely support the platen over a long period of time.

In the above embodiment, each position detecting rod may be made of carbon fibers, glass fibers, ceramics, or compounded materials reinforced with a metal rod, so that the thermal expansion effect can be as little as possible. Each position detecting rod may be spherically mounted with a couple of spherical surface connecting means so that the detecting rod can be always vertically maintained. Furthermore, it is desirable that the platen is supported on the supporting rods by means of a couple of spherical and slidable supporting devices.

Furthermore, the lower portion of the supporting rods and detecting means may be mounted in the bed so that the levelling devices can be arranged at a lower height and the press equipment can be compactly constructed.

Furthermore, the position detecting means may consist of supersonic wave detecting means or optical detecting means in which at the upper portion of the supporting rods, receivers are provided at the lower portion of their rods and transmitters coupled with these receivers are respectively provided.

The above described press equipment is not limitted for producing sheet molding compound parts, and it may be applied to flow-molding press equipment in which bulk molding materials are put in the mold.

While the invention has been described in terms of the embodiments herein illustrated, it is not intended that the invention be limitted to the details shown since various modifications and structural changes may be made without departing in any way from the spirit and scope of the present invention. Such modifications are intended to be included within the scope of the following claims.

What is claimed is:

1. A molding apparatus for press molding materials into molded parts which comprises a platen slidably supported within a lateral frame, an upper mold half attached to said platen, a lower bed, a lower mold half disposed on said lower bed, levelling means supported by said lower bed on opposite sides of said lower mold half, said levelling means containing hollow supporting rods slidably disposed for laterally supporting and levelling said platen within said lateral frame, and position detecting means mounted in said hollow supporting rods for detecting the height of the supporting rods, so that the levelling means can be synchronously controlled.

2. The apparatus of claim 1, wherein the position detecting means consist of straight rigid position detecting rods having position detectors operatively associated therewith, the upper ends of the position detecting rods being vertically secured to the supporting rods and the lower portions thereof extending out from the supporting rods, and said position detectors being provided at the lower portions of the position detecting rods so that their height and speed are detected and synchronously controlled.

3. The apparatus of claim 2, wherein the straight rigid position detecting rods are vertically and slidably mounted in bearings at their lower portions.

4. The apparatus of claim 1, wherein the lower portions of the position detecting means extend into the bed.

5. The apparatus of claim 1, wherein the position detecting rods are formed of materials which possess a small amount of thermal expansion.

6. The molding apparatus of claim 1 wherein the levelling means further includes hydraulic servocylinders with said hollow supporting rods being double rods for supporting the platen.

7. The molding apparatus of claim 1 wherein a compression cylinder is provided for moving the platen.

8. The molding apparatus of claim 1 wherein the levelling means are disposed at the four corners of the lower bed.

9. The molding apparatus of claim 1 wherein a lower free end portions of the position detecting rods are not secured in the levelling means.

* * * * *